United States Patent [19]

Steffen

[11] 4,136,665

[45] Jan. 30, 1979

[54] WOOD-BURNING STOVE

[76] Inventor: Peter U. Steffen, 159 Randlewood Close N.E., Calgary, Alberto, Canada, T1Y 2P2

[21] Appl. No.: 845,265

[22] Filed: Oct. 25, 1977

[51] Int. Cl.[2] ..... F24C 15/30; F24B 7/00

[52] U.S. Cl. ..... 126/123; 126/126

[58] Field of Search ..... 126/123, 126, 120, 121, 126/225; 237/51, 52

[56] References Cited

U.S. PATENT DOCUMENTS

| | | | |
|---|---|---|---|
| 1,615,741 | 1/1927 | Brown | 126/123 |
| 2,322,016 | 6/1943 | Hardeman | 237/51 |
| 4,036,205 | 7/1977 | Hayes | 126/126 |

*Primary Examiner*—Mervin Stein
*Assistant Examiner*—Alex Grosz
*Attorney, Agent, or Firm*—Daniel Jay Tick

[57] ABSTRACT

An airtight combustion chamber in a house has a draft hole formed through a first end and a draft door movably mounted thereon to selectively open the draft hole to a desired extent, controlled by a thermostat. The wall of the second spaced opposite end of the combustion chamber has a steel stove door movably mounted thereon. The second end coincides with a doorway formed through a chimney wall which is common with the house. Wood is supplied to the stove through the stove door for combustion. The products of combustion are removed from the stove via the stove door. The stove door has a smoke pipe extending therethrough into the chimney and a damper on the end of the pipe. Heat from the fire in the airtight chamber escapes into the house through decorative screens above and in front of the stove, simultaneously warming rock or brick walls at the sides of the stove and a rock or brick wall of the house.

2 Claims, 4 Drawing Figures

WOOD-BURNING STOVE

BACKGROUND OF THE INVENTION

The present invention relates to a wood-burning stove.

Objects of the invention are to provide a wood-burning stove of simple structure, which is inexpensive in manufacture, installable with facility and convenience by skilled and unskilled people, and functions efficiently, effectively and reliably to effectively heat a house, the size of the stove depending upon the size of the house.

The stove of the invention has a thermostat-controlled oxygen supply. The stove of the invention is slow-burning, so that refilling with wood is necessary only after two to four days. Since wood is supplied to the stove from outside the house, there is no wood debris or ashes in the house.

BRIEF DESCRIPTION OF THE DRAWINGS

In order that the invention may be readily carried into effect, it will now be described with reference to the accompanying drawings, wherein.

DETAILED DESCRIPTION OF THE INVENTION

Figure 1:
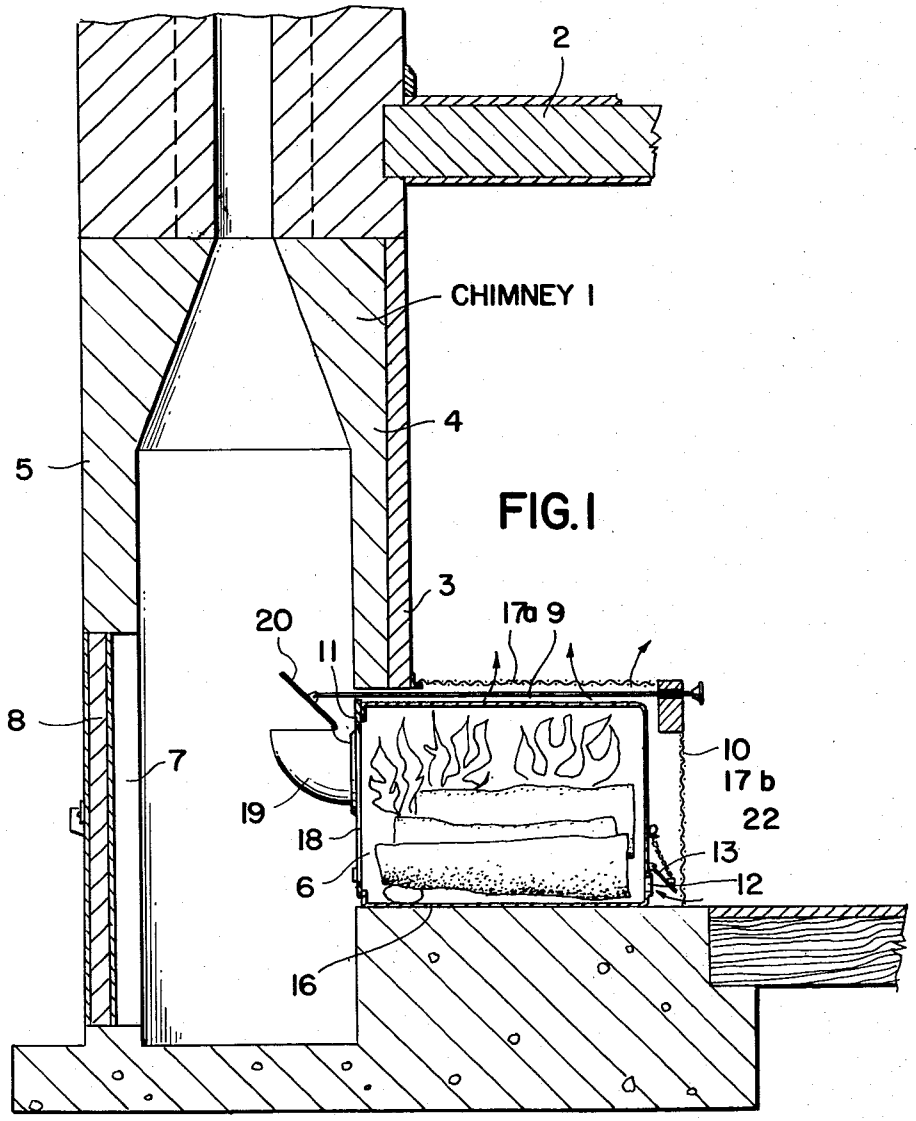
FIG. 1 is a sectional view of an embodiment of the wood-burning stove of the invention, as installed.

The wood-burning stove of the invention is installed at a chimney 1 of a house 2, as shown in FIG. 1. The chimney 1 is adjacent a wall 3 of the house, built of rock or brick, and has first and second spaced opposite chimney walls 4 and 5 (FIG. 1). The first chimney wall 4 abuts the wall 3 of the house 2 and the second chimney wall 5 is outside and spaced from the house, as shown in FIG. 1. The first chimney wall 4 and the wall 3 of the house have a first doorway 6 formed therethrough (FIG. 1). The second chimney wall 5 has a second doorway 7 formed therethrough (FIG. 1). A door 8 is thermally insulatedly movably mounted in the second doorway 7 to provide access to the chimney 1.

Figure 2:
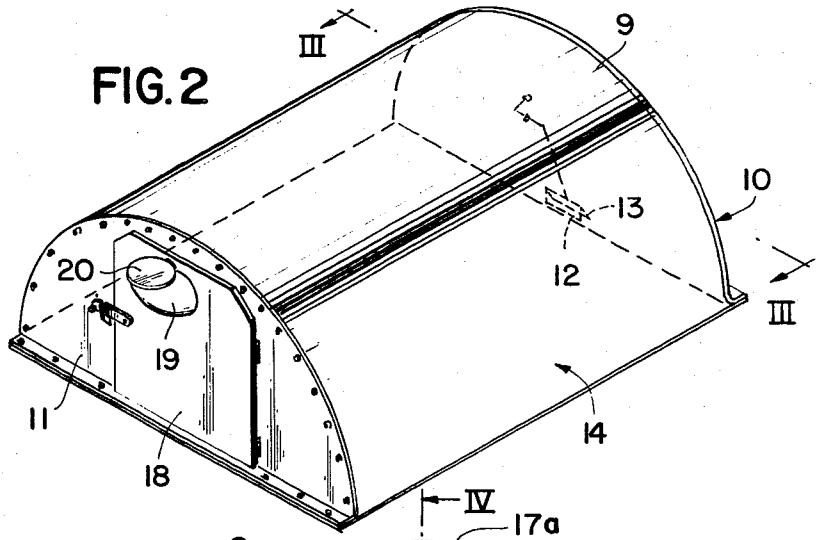
FIG. 2 is a perspective view, on an enlarged scale, of the embodiment of FIG. 1.

The wood-burning stove of the invention comprises an airtight combustion chamber 9, except for a draft hole and smoke pipe, in the house 2. The chamber 9 has first and second spaced opposite ends 10 and 11 (FIGS. 1 and 2). The first end 10 of the combustion chamber 9 has a draft hole 12 formed therethrough (FIGS. 1, 2 and 4) and a draft door 13 movably mounted thereon to selectively open said draft hole to a desired extent, as shown in FIGS. 1 to 4. The wall of the end 11 has a steel stove door which coincides with the first doorway 6 of the first chimney wall 4, as shown in FIG. 1. The airtight combustion chamber 9 has a bottom 16 (FIGS. 1, 3 and 4), sides 14 and 15 and a top. The sides 14 and 15 of the chamber 9 are formed by steel sheet, bolted or welded to the first and second ends 10 and 11.

A stove door 18 is movably mounted in the second end wall 11 of chamber 9 (FIG. 2) for supplying wood to the stove for combustion and for removing the products of combustion from the stove (FIGS. 1 and 2). The stove door 18 has a smoke pipe 19 extending therethrough into the chimney 1, as shown in FIG. 1, and a damper 20 on the end of said smoke pipe (FIGS. 1 and 2). Heat from the fire in the airtight chamber 9 flows into the house 2 through screens **17*a* and 17*b* above and in front of the stove 9. The heat simultaneously warms the rock or brick walls at the sides of the stove 9, supporting the screens 17*a* and 17*b*, and the rock or brick wall 3 of the house 2**.

The screens **17*a* and 17*b***, forming the top and front of the rock or brick encasing of the stove, conceals the steel structure of the stove, permits heat to flow faster than a steel sheet and has decorative purposes, as well.

Figure 3:
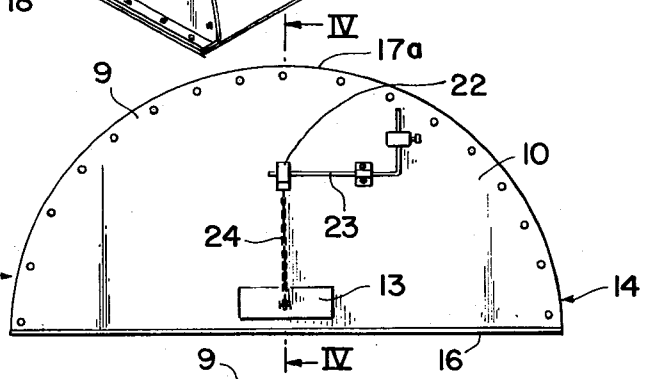
FIG. 3 is a view, taken along the lines III—III, of FIG. 2.
Figure 4:
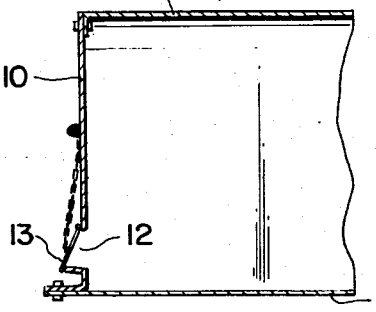
FIG. 4 is a sectional view, taken along the lines IV—IV, of FIG. 3.

A thermostatic control device 22 of any suitable type controls the opening of the draft door 13 via a suitable coupling arrangement 23, 24, as shown in FIGS. 1 and 3, to control the opening of the draft door in accordance with a desired temperature of the house.

While the invention has been described by means of a specific example and in a specific embodiment, I do not wish to be limited thereto, for obvious modifications will occur to those skilled in the art without departing from the spirit and scope of the invention.

I claim:

1. A wood-burning stove for installation at a chimney of a house, said chimney being adjacent a rock, brick, and the like, wall of the house and having first and second spaced opposite chimney walls, the first chimney wall abutting the wall of the house and the second chimney wall being outside and spaced from the house, the first chimney wall and the wall of the house having a first doorway formed therethrough and the second chimney wall having a second doorway formed therethrough, and a door thermally insulatedly movably mounted in the second doorway to provide access to the chimney, said wood-burning stove comprising a substantially airtight combustion chamber in the house, said chamber having first and second spaced opposite ends, the first end having a draft hole formed therethrough and a draft door movably mounted thereon to selectively open the draft hole to a desired extent, the second end coinciding with the first doorway of the first chimney wall, sides and a top;

a stove door movably mounted in the second end of the chamber for supplying wood to the stove for combustion and for removing the products of combustion from the stove, said stove door having a smoke pipe extending therethrough into the chimney and a damper on the end of said smoke pipe; and decorative screens at the top and the front of the chamber for permitting heat from a fire in the chamber to flow into the house therethrough to simultaneously warm rock, brick, and the like, walls at the sides of the stove and the rock, brick, or the like, wall of the house.

2. A wood-burning stove as claimed in claim 1, further comprising a thermostatic control device for controlling the opening of the draft door in accordance with a desired temperature of the house thereby providing slow burning of wood in the chamber and making fuel supply unnecessary for days.

* * * * *